United States Patent [19]

Pahnke

[11] Patent Number: 4,819,518

[45] Date of Patent: Apr. 11, 1989

[54] LOADING SYSTEM FOR CONTAINERS HOLDING CARTRIDGED AMMUNITION

[75] Inventor: Klaus-Dieter Pahnke, Solingen, Fed. Rep. of Germany

[73] Assignee: Rheinmetall GmbH, Düsseldorf, Fed. Rep. of Germany

[21] Appl. No.: 146,697

[22] Filed: Jan. 21, 1988

[30] Foreign Application Priority Data

Jan. 29, 1987 [DE] Fed. Rep. of Germany ..... 3702603

[51] Int. Cl.[4] ..... F41F 9/04; F41F 9/06

[52] U.S. Cl. ..... 89/46; 89/47

[58] Field of Search ..... 89/45, 46, 47; 901/14, 901/15, 17

[56] References Cited

U.S. PATENT DOCUMENTS

| | | | |
|---|---|---|---|
| 1,753,850 | 4/1930 | de Courseulles . | |
| 3,320,857 | 5/1967 | Carlsson . | |
| 3,503,527 | 3/1970 | Devol | 901/17 |
| 3,888,362 | 6/1975 | Fletcher et al. | 901/17 |
| 4,318,331 | 3/1982 | Echtler et al. | 89/47 |
| 4,648,305 | 3/1987 | Elspass | 89/45 |

FOREIGN PATENT DOCUMENTS

| | | | |
|---|---|---|---|
| 176426 | 4/1986 | European Pat. Off. . | |
| 2224349 | 11/1973 | Fed. Rep. of Germany | 901/15 |
| 2531936 | 3/1977 | Fed. Rep. of Germany | 89/46 |
| 2640609 | 3/1977 | Fed. Rep. of Germany . | |
| 3022410 | 12/1981 | Fed. Rep. of Germany . | |
| 3430915 | 3/1986 | Fed. Rep. of Germany | 901/15 |
| 2467379 | 4/1981 | France | 89/47 |
| 2028984 | 3/1980 | United Kingdom . | |
| 2153496 | 8/1985 | United Kingdom . | |
| 2153497 | 8/1985 | United Kingdom . | |

OTHER PUBLICATIONS

Pan, Army Research, Development, and Acquisition Magazine, 9-10/83, pp. 15-17.

Jenkins, D.H.C., "Ladeautomaten für Panzer", International Wehrrevue, Jul. 1984, p. 907.

"Handbook on Weaponry", (Second English Edition), Rheinmetal GmbH (Düsseldorf, Federal Republic of Germany), 1982, pp. 405-410.

*Primary Examiner*—Deborah L. Kyle
*Assistant Examiner*—Stephen Johnson
*Attorney, Agent, or Firm*—Spencer & Frank

[57] ABSTRACT

A loading system for containers holding ammunition in an armored vehicle having a tubular weapon composed of a gun cradle and a barrel having a bore axis, the weapon being mounted in a top gun mount which is rotatable about an azimuth axis, which system includes a first transporting device for transporting a container from a magazine holding a plurality of containers and disposed in a rear section of the armored vehicle into a loading position behind the top gun mount. The system further includes a plurality of such containers, each composed of at least two cells, each cell accommodating a respective cartridge, and connecting elements for connecting the cells in a form and force locking manner for transport to the loading position. The first transporting device is composed of a combined depositing and conveying device which is fixed on the gun cradle and extends transversely to the bore axis of the gun barrel, the combined device including elements for transporting the cells of a container to an insertion position aligned with the bore axis. The system further includes a second transporting device composed of a basic body rotatable about the azimuth axis of the top gun mount independently of the rotation of the top gun mount about the azimuth axis, a gripping device for gripping a container in the rear section magazine of the armored vehicle, and at least four further members arranged one behind the other in a multiple joint arrangement connecting the gripping device to the basic body.

13 Claims, 5 Drawing Sheets

LOADING SYSTEM FOR CONTAINERS HOLDING CARTRIDGED AMMUNITION

BACKGROUND OF THE INVENTION

The present invention relates to a loading system for containers holding cartridged ammunition in an armored vehicle carrying a top gun mounted tubular weapon which is pivotable about a generally horizontal axis, the system including a first transporting device for transporting a container from a magazine holding a plurality of containers and disposed in a rear section of the vehicle into a loading position behind the weapon.

In armored vehicles, such systems serve to automatically supply ammunition to the weapon in place of manual loading operations by crew members. The use of machine aids to automate the loading process, eliminates the need for a crew member to leave the protective enclosure of the vehicle, on the one hand, and increases the speed of the loading cycle, on the other hand. The use of containers, each holding a plurality of cartridges, permits repeated firing without reloading.

DE-OS [Federal Republic of Germany Laid-Open Application] No. 3,022,410 and counterpart U.S. Pat. No. 4,466,333 disclose such a loading system in which the containers on the exterior of the weapon carrier, which is not protected by the armored cover, are reloaded by machine from the interior of the vehicle.

In the tail section of the armored vehicle disclosed in those references, there is disposed a container reloading station from which a full container can be supplied to the weapon over a container displacement path. When the empty container is removed or a new full container is supplied, the weapon is in an indexed position.

A drawback of this known loading system is the fact that the weapon must be in an indexed position for the loading and unloading process. This is applicable, in particular, if, as proposed in those references, the indexed position is defined by the highest possible gun barrel elevation. In addition to the loading or reloading time delay incurred by the setting to such an indexed position, the high elevation at which the gun barrel must placed, as customary, for example, for armored artillery vehicles, enlarges the silhouette of the vehicle in a dangerous manner.

A further loss of time during loading occurs in the loading system according to the above-cited references since an empty container must be brought into the container replenishing station over the displacement path before a new full container can be supplied to the weapon over the same displacement path. During the entire period of this process, the tubular weapon is in the indexed position.

SUMMARY OF THE INVENTION

It is an object of the present invention to provide a loading system which permits a quick, continuous and automatic loading process.

A further object of the invention is to permit the supplying of one-way containers holding cartridged ammunition to the weapon, independently of the elevation and azimuth of the weapon.

The above and other objects are achieved, according to the present invention, in a loading system for containers holding ammunition in an armored vehicle having a tubular weapon composed of a gun cradle and a barrel having a bore axis, the weapon being mounted in a top gun mount which is rotatable about an azimuth axis, which system includes a first transporting device for transporting a container from a magazine holding a plurality of containers and disposed in a rear section of the armored vehicle into a loading position behind the top gun mount, by the improvement wherein:

(a) the system comprises a plurality of such containers, each composed of at least two cells, each cell accommodating a respective cartridge, and connecting means for connecting the cells in a form and force locking manner for transport to the loading position;

(b) the first transporting device comprises a combined depositing and conveying device which is fixed on the gun cradle and extends transversely to the bore axis of the gun barrel, the combined device including means for transporting the cells of a container to an insertion position aligned with the bore axis; and (c) the system further comprises a second transporting device composed of a basic body rotatable about the azimuth axis of the top gun mount independently of the rotation of the top gun mount about the azimuth axis, a gripping device for gripping a container in the rear section magazine of the armored vehicle, and means including at least four further members arranged one behind the other in a multiple joint arrangement connecting the gripping device to the basic body.

Advantageous features and modifications of the invention will be described below.

The invention will now be described in greater detail with reference to a preferred embodiment that is illustrated in the drawing.

DESCRIPTION OF THE PREFERRED EMBODIMENTS

Figure 1:
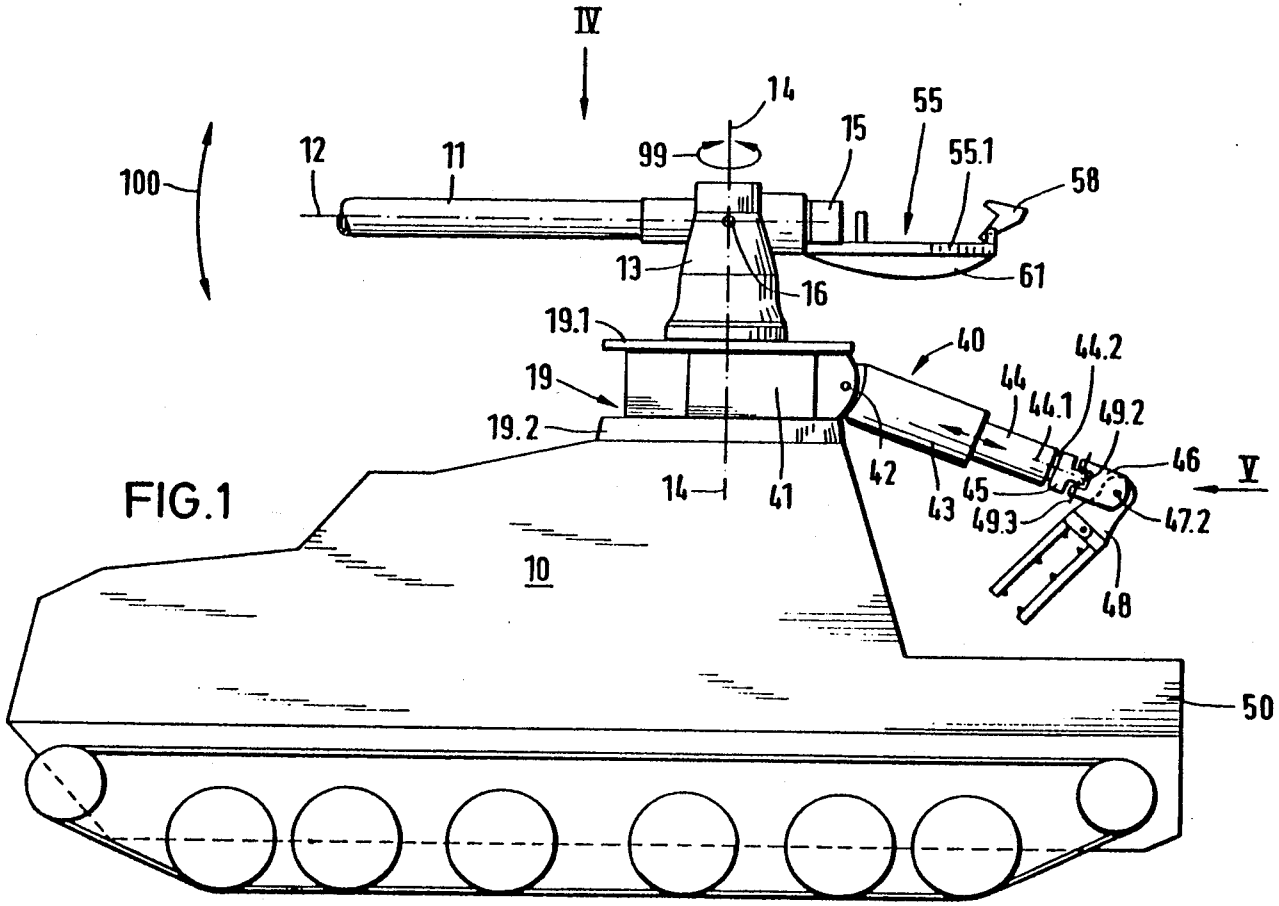
FIG. 1 is a simplified pictorial side elevational view showing the basic structure of the preferred embodiment of a loading system according to the invention for containers holding cartridged ammunition and mounted on an armored vehicle.

FIG. 1 shows an armored vehicle in the form of a tank 10 having a tubular weapon 11 which includes a gun barrel having a bore axis 12 mounted in a top gun mount 13. Weapon 11 includes a breechblock 15. Top gun mount 13 is rotatable about a normally vertical azimuth axis 14 and the gun barrel is adjustable in elevation about a joint 16 in top gun mount 13.

Referring to FIGS. 4–8 in conjunction with FIG. 1, a first transporting device 55, including a holding device 58 and a rammer 31 having a cover 61, is fixed to the gun cradle 17 of gun barrel 11. Between top gun mount 13 and armored vehicle 10, there is disposed a sleeve 19 formed of a first disc 19.1, a second disc 19.2 and a hollow cylinder 19.3 which connects discs 19.1 and 19.2. Top top gun mount 13 includes a shaft 54, shown in FIG. 5, which is rotatable about the azimuth axis 14 in sleeve 19.

Between first disc 19.1 and second disc 19.2, there is disposed the basic element 41 of a second transporting device 40. This basic element 41 is rotatable about the azimuth axis 14 on sleeve 19 connected with armored vehicle 10. Such rotation is independent of the azimuth rotation 99 of top gun mount 13. Basic element 41 of second transporting device 40 carries a rotary joint 42 to which a first member 43 is pivotally mounted in such a manner that member 43 can be pivoted down or up with respect to basic element 41 about an axis of rotation 42.1, shown in FIG. 4, transverse to azimuth axis 14.

At its free end, first member 43 is connected with a second member 44 which is longitudinally displaceable and telescoped relative to member 43, so that second member 44, if required, can be pulled completely into first member 43. The end of second member 44 is connected with a third member 45 via a rotary joint 44.2 which rotates third member 45 about a longitudinal axis 44.1. The end of third member 45 is connected with a fourth member 46 via a rotary joint 49.2 so that fourth member 46 can be moved relative to third member 45 about an axis 49.3 perpendicular to longitudinal axis 44.1. The free end of fourth member 46 is connected by way of a rotary joint 47.2 with a gripping device 48 so that the latter can be pivoted about an axis 47.1 (FIG. 4) which is disposed transversely to the axis 49.3 of rotary joint 49.2 between third member 45 and fourth member 46.

The embodiment shown in FIG. 1 makes it possible for the gripping device 48 of second transporting device 40 to pick up a container 20 (FIG. 2) holding cartridged ammunition from a fixed position in the tail section 50 of the armored vehicle 10 and to transport this container 20 (FIG. 2) independently of the azimuth 99 and elevation 100 settings of gun barrel 11, to the depositing device 55.1 and the conveying device 57 of first transporting device 55 and to deposit it there. No index position in elevation 99 and azimuth 100 of gun barrel 11 is needed for such a transporting process.

For the sake of clarity, none of the drives required to move the components of the loading device are illustrated in FIG. 1 or in any of the other drawing figures since they are not significant to the invention and can be realized in a known manner.

Figure 2:
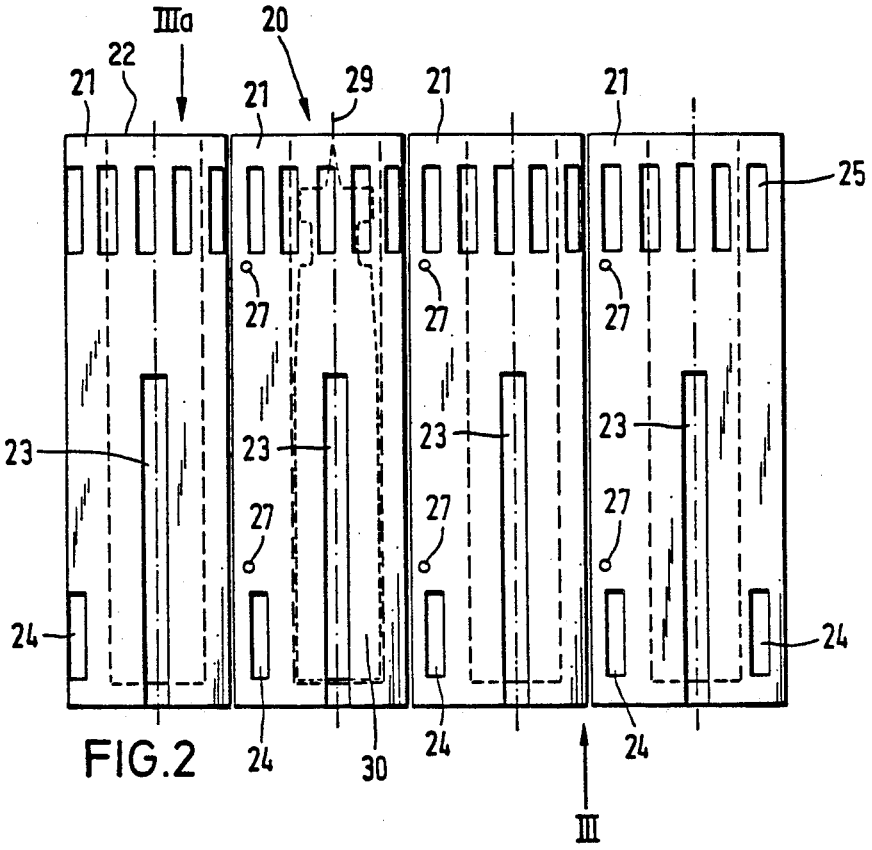
FIG. 2 is an elevational view of the long side of an embodiment of a container for holding cartridged ammunition.
Figure 3:
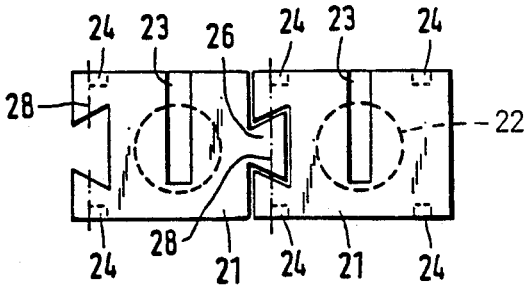
FIG. 3 and FIG. 3*a* are side views of two cells of the container in the direction of the arrows III and III*a* of FIG. 2 respectively.
Figure 3A:
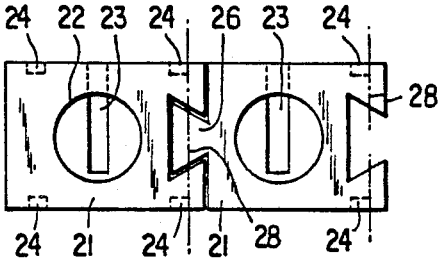

FIGS. 2 and 3 show an advantageous embodiment of the container 20 holding cartridged ammunition and composed of, for example, four individual cells 21. Each cell 21 contains a cartridge 30 having a longitudinal axis 29. Cells 21 form container 20 by way of form-locking dovetail connections 26 which are secured by shear pins 27, whose axes 28 are perpendicular to longitudinal axis 29, for transport by the second transporting device 40 (FIG. 1) relative to the first transporting device 55 (FIG. 1). Thus the longitudinal displacement of cells 21 relative to one another, which would be possible in principle with dovetail connections, is prevented during this transporting process.

Figure 6:
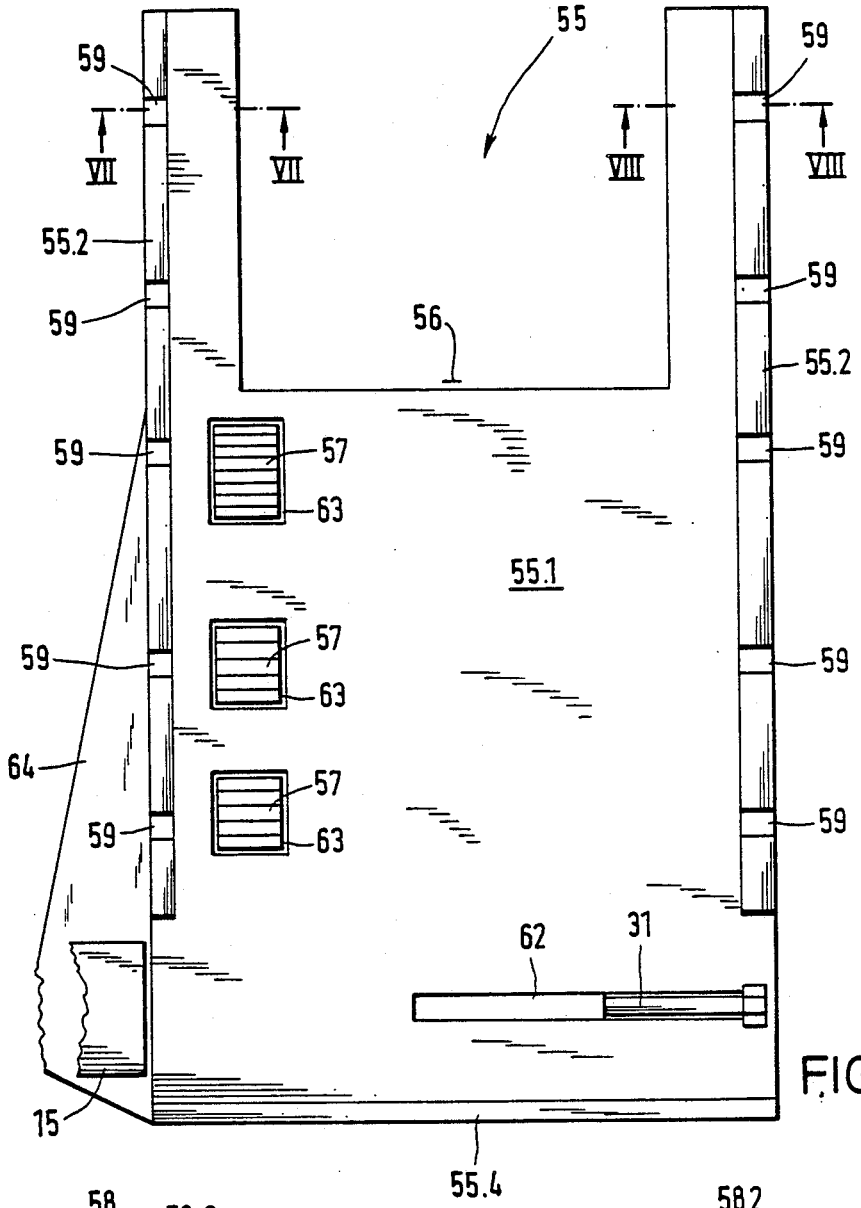
FIG. 6 is a top view of a first transporting device forming part of the system of FIG. 1.

On each one of the longitudinal side faces of container 20, each cell 21 is provided with a recess 23 for engagement of a known rammer 31 (FIG. 6). Additionally, each longitudinal side face is provided with recesses 25 for engagement of the conveying device 57 (FIG. 6) of the first transporting device 55 (FIG. 1). Moreover, each longitudinal side face of container 20 is provided with recesses 24 for engagement of lugs (not numbered here) at the interior of the gripping device 48 of second transporting device 40 (FIG. 1) which permit, in an advantageous manner, secure engagement of container 20 by means of gripping device 48 (FIG. 1). The gripping device 48 consists mainly of two parallel plates or elements of U-shape which, due to their pivotal connection, can be driven open or closed to grip a container 20 like a clamp. The lugs at the interior of the gripping device fit into the grooves of the recesses 24 and into the two outer grooves of recesses 25 in order to provide properly secured lifting and transportation of the containers 20.

Shear pins 27 are dimensioned with respect to size and number so that they can be sheared off by the force of the recoiling gun barrel 11 (FIG. 1) after firing. Thus it is accomplished in an advantageous manner that a cell 21 which is empty after rammer 31 (FIG. 6) has inserted the cartridge, can be separated from the remainder of the container and discarded after firing. Immediately after the subsequent advance of gun barrel 11 (FIG. 1), a new cell 21 of the container 20 or a new cell 21 of a new container 20, is transported to the position of the just discarded cell 21. Thus, a new cartridge can be loaded and fired.

In a particularly advantageous embodiment, container 20 or, more precisely, the individual cells 21, are made of a known plastic material, for example of polyurethane, so that an economical container for one-time use is created.

Figure 4:
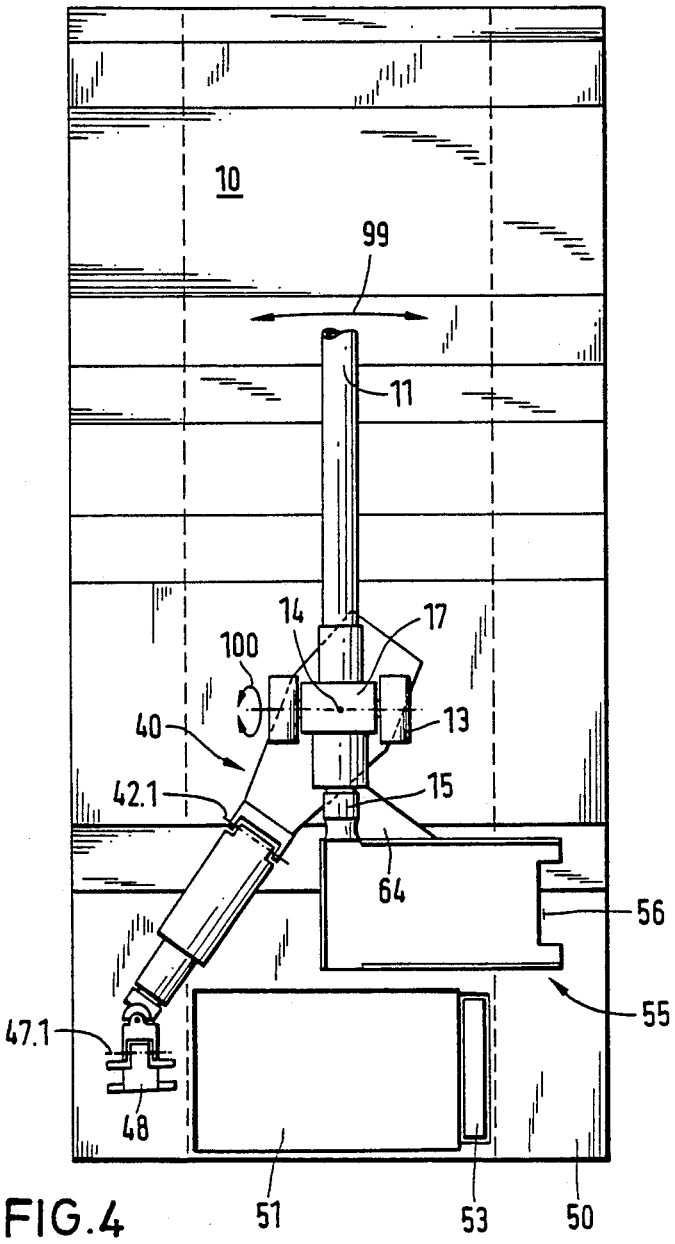
FIG. 4 is a top plan view showing the loading system in the direction of the arrow IV of FIG. 1.

FIG. 4 shows the loading system of FIG. 1 mounted on armored vehicle 10. The first transporting device 55 behind breechblock 15 is fixed to gun cradle 17 by means of a supporting plate 64 and thus follows the elevation 100 of gun barrel 11 and the lateral movement 99 of the top gun mount 13 around azimuth axis 14. Between armored vehicle 10 and top gun mount 13, there is disposed the second transporting device 40 which, as described in detail in connection with FIG. 1, is provided at its end with a gripping device 48 for gripping a container 20 (FIG. 2) holding the cartridged ammunition.

A plurality of containers 20 are disposed on end in a magazine 51 in the tail section 50 of the armored vehicle 10. Magazine 51 is essentially protected by strong armor.

In a conceivable, advantageous embodiment, not shown here, the magazine has a movable armor element at at least one externally accessible side face so as to permit filling of magazine 51. Additionally, magazine 51 includes an engagement opening 53 in which the gripping device 48 of second transporting device 40, once it has moved there, grips a container 20 (FIG. 2). Once the second transporting device 40 has pulled the container completely out of engagement opening 53 of magazine 51, it transports container 20, independently of the elevation 100 and azimuth 99 of gun barrel 11, to the first transporting device 55 and deposits it thereon. First transporting device 55 includes a recess 56 to provide a space in which gripping device 48 can move to release a container 20 once it has been deposited there.

Figure 5:
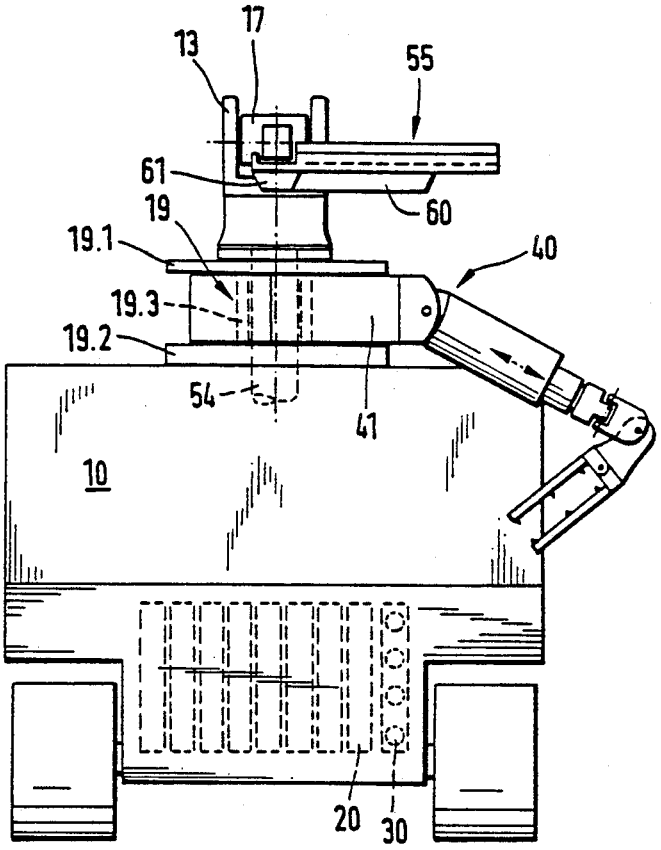
FIG. 5 is a rear view of the loading system in the direction of the arrow V of FIG. 1.

FIG. 5 shows armored vehicle 10 from the rear with the loading system for containers holding cartridged ammunition according to FIGS. 1 and 2. Top gun mount 13 is installed on armored vehicle 10, with its shaft 54 being rotatable in sleeve 19 connected with armored vehicle 10 and formed of first disc 19.1 and second disc 19.2 as well as hollow cylinder 19.3 connecting them. This allows lateral rotational movement of the weapon. The basic element 41 of second transporting device 40 is rotatably disposed around this sleeve 19. In the rear of armored vehicle 10, there are disposed a plurality of containers 20 holding cartridged ammunition in magazine 51 (FIG. 4). Each container 20 contains a plurality of cartridges 30 in a corresponding number of individual cells, preferably four, with the cartridges being in a horizontal orientation in magazine 51 (FIG. 4).

On the underside of first transporting device 55, which is fastened to gun cradle 17, there is shown the cover 61 for the rammer 31 (FIG. 6) and a housing 60 for the conveying devices 57 (FIG. 6) of the first transporting device 55.

FIG. 6 shows the first transporting device 55 of the loading system of FIG. 1 which is fixed by means of support plate 64 to gun cradle 17 (FIGS. 4 and 5) behind breechblock 15. Behind breechblock 15, there is disposed, in first transporting device 55, a recess 62 for known rammer 31. A depositing surface 55.1 of first transporting device 55 is provided with a plurality of recesses 63 holding a corresponding number, preferably three, of conveying devices 57, which are preferably toothed transporting wheels. These conveying devices 57 serve to advance containers 20 (FIG. 2) along first transporting device 55 to the insertion position behind breechblock 15.

According to another embodiment of a loading system for containers holding cartridged ammunition, it is conceivable to employ a sprocket belt as the conveying device 57.

The containers are advanced by engagement of conveying devices 57 in the corresponding recesses 25 (FIG. 2) in that side face of container 20 of FIG. 2 which lies directly on depositing surface 55.1. On its side facing away from breechblock 15, first transporting device 55 is provided with recess 56 which permits opening and withdrawal of the gripping device 48 (FIG. 1) of second transporting device 40 (FIG. 1) after a container has been deposited on first transporting device 55.

Except for the region around breechblock 15, depositing surface 55.1 is delimited by guide walls 55.2 which serve to guide containers 20 transported by conveying devices 57. Guide walls 55.2 are provided with recesses 59 in which holding devices 58 (FIGS. 7 and 8) are attached. The edge of depositing surface 55.1 remote from recess 56 is delimited by an abutment wall 55.4 extending transversely to guide walls 55.2.

Figure 7:
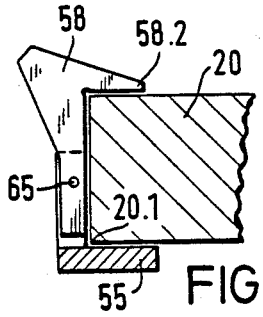
FIG. 7 is a cross-sectional view, along line VII—VII of FIG. 6, showing a first position of a holding device of the first transporting device.
Figure 8:
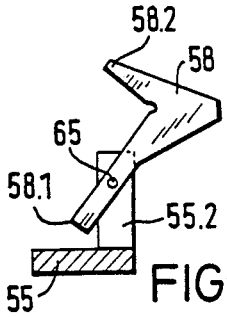
FIG. 8 is a cross-sectional view, along the line VIII—VIII of FIG. 6, showing a second position of the holding device of the first transporting device.

FIGS. 7 and 8 show an advantageous embodiment of holding devices 58 which are mounted on pivot joints 65 in recesses 59 of guide walls 55.2 of first transporting device 55. These holding devices 58 serve to retain containers 20 deposited on first transporting device 55 and prevent the deposited containers from jumping out due to shocks, e.g. during firing. If a container 20 is deposited by second transporting device 40 of FIG. 5 on first transporting device 55, a lower edge 20.1 of container 20 abuts against a lower edge 58.1 of a previously open holding device 58, the open position being shown in FIG. 8, and presses this lower edge 58.1 of holding device 58 outwardly. An upper tip 58.2 of holding device 58 is thus placed over container 20 and fixes the latter in its position on first transporting device 55, as shown in FIG. 7. Holding device 58 is configured so that its center of gravity lies at the other side of pivot joint 65 from the location of container 20. In this way a torque about the axis of pivot joint 65 is generated already at zero elevation of gun barrel 11 so that the holding device is open in the rest position.

The rammer 31 is preferably a flick rammer, a chain rammer or a roller rammer of such well-known types which are cited in Rheinmetall "Handbook on Weaponry", 2nd English Ed. 1982, ch. 8.3.1, p.p. 405 through 410 with refered drawings.

Such therein described and commonly used ramming devices could be easily combined with the inventive embodiment by each person skilled in the art.

Each cartridged ammunition holding cell 21 is preferably made of plastic material. Due to the recess 23, which extends from a front end of each cell 21 to about half of the length of each cell 21, the particular body section of each cell in the vicinity of the recess 23 could be elasticly, slightly expanded by internal forces from the interior. Therefore, the internal diameter of each cell 21 along the recess 23 is preferably a little bit smaller than the outer diameter of the cartridged ammunition, so that the rear portion of the cell 21 is slightly expanded by the inserted ammunition and a satisfactory gripping force is obtained for proper holding the ammunition inside the cell 21 for transporting purposes.

The cells 21 are loaded with ammunition by inserting the cartridges into the free opening open end 22 or in the front face of the each cell 21 (compared to FIG. 2 this is the top section of each cell). Each cartridge is pushed into the internal bore with its cartridge base ahead.

A certain number of containers 20, each comprising the desired number of coupled and secured cells 23 could be packed together on a transportation palette. Those ammunition palettes are well-known, and in respect to various standardized NATO sizes, could be delivered by other vehicles at the supplemental service corps.

A fully automated system inside the armored vehicle 10 is used for suitable observing and controlling the movement of the various components of transporting devices 40 and 55.

The invention now being fully described, it will be apparent to one of ordinary skill in the art that many changes and modifications can be made thereto without departing from the spirit or scope of the invention as set forth herein.

What is claimed:

1. In a loading system for containers holding ammunition in an armored vehicle having a tubular weapon composed of a gun cradle and a barrel having a bore axis, the weapon being mounted in a top gun mount which is rotatable about an azimuth axis, which system includes a first transporting device for transporting a container from a magazine holding a plurality of containers and disposed in a rear section of the armored vehicle into a loading position behind the top gun mount, the improvement wherein:

(a) said system comprises a plurality of such containers, each composed of at least two cells, each said cell accommodating a respective cartridge, and connecting means for connecting said cells in a form and force locking manner for transport to the loading position;

(b) said first transporting device comprises a combined depositing and conveying device which is fixed on the gun cradle and extends transversely to the bore axis of the gun barrel, said combined device including means for transporting the cells of a said container to an insertion position aligned with the bore axis; and (c) said system further comprises a second transporting device composed of a basic body rotatable about the azimuth axis of the top gun mount independently of the rotation of the top gun mount about the azimuth axis, a gripping device for gripping a container in the rear section magazine of the armored vehicle, and means including at least four further members arranged one behind the other in a multiple joint arrangement connecting said gripping device to said basic body.

2. Loading system as defined in claim 1 wherein each said cell has a longitudinal axis, an open end for insertion of a cartridge extending transverse to the longitudinal axis, and an outer longitudinal face extending parallel to the longitudinal axis in the direction of insertion of the cartridge, and wherein the outer longitudinal face is provided with first recesses for engagement by the first transporting device.

3. Loading system as defined in claim 2 wherein said outer longitudinal face of each said cell is additionally provided with a second recess for engagement of a rammer.

4. Loading system as defined in claim 2 wherein each said cell has two oppositely disposed outer longitudinal faces extending parallel to the longitudinal axis, and each said outer longitudinal face is provided with recesses for engagement of said gripping device of the first transporting device.

5. Loading system as defined in claim 4 wherein one of said two outer longitudinal faces of each said cell is provided with recesses for engagement of said first transporting device and recesses for engagement of a rammer.

6. Loading system as defined in claim 1 wherein said cells are made of a plastic material.

7. Loading system as defined in claim 1 wherein each said cell has a longitudinal dimension parallel to a longitudinal axis of its respective cartridge and said connecting means for connecting said cells to form a container are constructed for permitting longitudinal displaceability of said cells relative to one another parallel to the longitudinal dimension of said cells.

8. Loading system as defined in claim 7 wherein said connecting means for connecting said cells are constructed to provide a dovetail connection between adjacent cells of a container.

9. Loading system as defined in claim 1 wherein said connecting means comprise shear pins connecting adjacent cells to provide a force locking connection therebetween, said shear pins preventing relative longitudinal displacement of said cells during transport of a container into the insertion position, and said shear pins being shearable by the force of the recoiling breechblock of said gun barrel after firing of said weapon.

10. Loading system as defined in claim 1 wherein each said container is provided with recesses for engagement by said first transporting device, and said first transporting device comprises at least one conveying device which, by engagement in said recesses of a said container deposited on said transporting device, transport one cell of said container at a time into the insertion position behind the breechblock.

11. Loading system as defined in claim 18 wherein said conveying device comprises sprocket belts.

12. Loading system as defined in claim 18 wherein said conveying device comprises toothed transporting wheels.

13. Loading system as defined in claim 1, wherein: said means including at least four further members comprise first, second, third and fourth further members connected to one another in sequence, with said first and second further members extending along a longitudinal axis; said second member is supported by said first member and said second member is displaceable along said longitudinal axis in a telescoping manner; and said second transporting device further comprises a first rotary joint connecting said first further member to said basic body for permitting said first further member to be pivoted in a vertical plane, a second rotary joint connecting said third further member to said second further member for permitting said third further member to rotated about said longitudinal axis, a third rotary joint connecting said fourth further member to said third further member for permitting said fourth further member to be pivoted about an axis perpendicular to said longitudinal axis, and a fourth rotary joint connecting said gripping device to said fourth further member for permitting said gripping device to be pivoted about an axis which is disposed transversely to the pivot axis defined by said third rotary joint.

* * * * *